US006312499B1

(12) United States Patent
Rehmat et al.

(10) Patent No.: US 6,312,499 B1
(45) Date of Patent: Nov. 6, 2001

(54) METHOD FOR STABILIZATION OF LIQUID MERCURY

(75) Inventors: Amirali G. Rehmat, Darien; Anil Goyal, Willowbrook, both of IL (US); Douglas H. Laird, San Diego, CA (US)

(73) Assignee: Institute of Gas Technology, Des Plaines, IL (US)

( * ) Notice: Subject to any disclaimer, the term of this patent is extended or adjusted under 35 U.S.C. 154(b) by 0 days.

(21) Appl. No.: 09/564,330

(22) Filed: May 3, 2000

Related U.S. Application Data

(60) Provisional application No. 60/133,088, filed on May 7, 1999.

(51) Int. Cl.[7] ..... C22C 7/00

(52) U.S. Cl. ..... 75/388; 75/742; 420/590; 588/15

(58) Field of Search ..... 75/388, 742; 420/526, 420/587, 590; 588/15

(56) References Cited

U.S. PATENT DOCUMENTS

| | | | |
|---|---|---|---|
| 3,804,751 | 4/1974 | McCord et al. . | |
| 3,975,298 | 8/1976 | Seidenberger . | |
| 4,076,553 | 2/1978 | Seidenberger . | |
| 4,164,419 | 8/1979 | Kaji et al. . | |
| 4,844,815 | 7/1989 | Ader et al. . | |
| 5,034,054 | 7/1991 | Woodward | 75/388 |
| 5,061,442 * | 10/1991 | Ozimek | 420/526 |
| 5,409,522 | 4/1995 | Durham et al. . | |
| 5,556,447 | 9/1996 | Srinivasachar et al. . | |

FOREIGN PATENT DOCUMENTS

| | | | |
|---|---|---|---|
| 57-45387 * | 3/1982 | (JP) | 75/388 |
| 2239025 | 7/1987 | (JP) . | |
| 2239026 | 7/1987 | (JP) . | |
| 2296926 | 9/1987 | (JP) . | |

* cited by examiner

*Primary Examiner*—Melvyn Andrews
(74) *Attorney, Agent, or Firm*—Pauley Petersen Kinne & Fejer

(57) ABSTRACT

A method for stabilization of liquid mercury in which powdered copper particles are cleaned with a chemically reactive fluid suitable for removing surface oxidation from the surface. "Clean" powdered copper particles are mixed with liquid mercury to form a powdered copper/liquid mercury mixture. The mixture is then hardened to form an amalgam. Amalgams in which the amount of mercury is greater than 50% by weight of the total amalgam may be produced in accordance with the method of this invention.

12 Claims, No Drawings

METHOD FOR STABILIZATION OF LIQUID MERCURY

This Application claims benefit of Provisional No. 60/133,088 filed May 7, 1999.

BACKGROUND OF THE INVENTION

1. Field of the Invention

This invention relates to a method for stabilizing metallic liquid mercury in an environmentally benign, monolithic solid form for storage or disposal. The method of this invention is capable of producing an amalgam of copper and mercury in which the mercury comprises greater than about 50% by weight of the total weight of the amalgam. The amalgam produced in accordance with the method of this invention is resistant to deformation, breakage, chemical corrosion, and environmental release of its mercury content. The mercury thus sequestered can be disposed of by burial, for example, or it can be separated from the copper and recovered by distillation after storage. The method of this invention does not require the use of silver, tin, nickel, indium or other expensive metals or alloys and, thus, it is quite economical.

2. Description of Prior Art

An amalgam is an alloy of mercury and at least one other metal. Many, but not all, metals form alloys with mercury. Most of the amalgams are solid solutions of variable proportions. For example, it is well known that gold readily absorbs mercury to form either solid amalgam or, with higher mercury content, a liquid metal solution. This absorption of mercury by gold is the basis for a variety of methods used to remove harmful mercury vapor from gases and liquids and it can also be used to measure the mercury content in fluids. U.S. Pat. No. 5,409,522 teaches a method and apparatus for removing particulate material and mercury-containing compounds from a gas stream which includes a mercury collection means for removing the mercury-containing compounds. The mercury collection means include a mercury collection surface having a mercury adsorptive capacity no less than about 0.1 micrograms/$cm^2$. Suitable mercury collection surfaces are indicated to include gold, silver, sodium, palladium, potassium, platinum, copper, and mixtures thereof, with the most preferred collection surface being gold. The absorption of mercury by gold also provides a method for extracting gold from it ores. No pretreatment of the gold surface is required, and the mercury can be vaporized from the gold and separated by heating. However, it will be apparent that as a disposable sorbent, gold is too expensive.

It has also long been known that mercury forms a stable solid amalgam with powdered silver at room temperature. Alloy powders containing minor amounts of copper, zinc, tin, and/or indium with silver in the dominant proportion behave similarly to pure silver powder in this regard. See, for example, U.S. Pat. No. 4,164,419 which teaches a powdered alloy for dental amalgam consisting essentially, by weight, of at least 50% silver, 20–30% tin, 3–6% indium and 11–20% copper. When mercury is first mixed with silver-rich powders, it forms a metallic slurry having the consistency of a paste which can be formed and shaped by hand. The paste solidifies in minutes and reaches maximum strength in roughly 24 hours. This is the dental amalgam used to fill cavities in teeth. It is hard enough to withstand the pressures of chewing, often for decades. And, although dissolved mercury is quite toxic, this amalgam is so inert to chemical reaction that no harm is done even considering the broad pH range of foods, from about 1.8 to about 8.5, to which the amalgam is exposed. Even with this broad pH range, combined with chewing abrasion, mercury is not released from fillings into the saliva in harmful amounts. However, as in the case of gold, silver is relatively expensive for use as a disposable sorbent. Accordingly, it is apparent that there is a need for an amalgam having the hardness and chemical stability of dental amalgam that does not require silver or any other expensive elements. Such an alloy would be useful not only for the storage and disposal of mercury, but also in room temperature casting, joining and repair of metal objects.

U.S. Pat. No. 5,034,054 teaches a method for treating mercury in preparation for disposal in which the mercury is mixed with an inorganic powder such as copper, zinc, nickel, or sulfur in a ratio of powder to mercury of at least 1:1 and preferably more on the order of 3:1 resulting in an amalgam in solid form in which the mercury is permanently bonded to the powder. To promote formation of the amalgam, the '054 patent teaches the use of mechanical "non-intrusive compound agitation" to overcome surface oxidation and bring the metals together at an atomic scale. The resulting amalgamation resembles a powderous copper. Attempts to operate the process at powder to mercury ratios of less then 1:1 result in a portion of the liquid mercury not being absorbed by the powder. Accordingly, it is apparent that, in order to reduce the waste volume and sorbent requirements for amalgamation, an amalgamation process which is capable of producing amalgams in which the mercury content is greater than 50% of the total mass is highly desirable.

As previously stated, the product of the process of the '054 patent is a "powderous" amalgam, which would be expected for a mixture containing less mercury than sorbent. Leaching of a toxic substance into ground water is approximately proportional to the specific surface area ($cm^2/g$) of the toxic substance exposed to the water. For example, the specific surface area of a 20-micron powder is one billion times the specific surface area of a 2 cm monolithic casting of the same shape. As a result, the leaching to be expected from such a casting is one billionth the leaching of the powder under equivalent conditions. Accordingly, it will be apparent that for applications in which the amalgam is to be buried, such as in land fills, a monolithic amalgam is preferable over powderous amalgams of similar composition.

In addition to copper, U.S. Pat. No. 5,034,054 also teaches that zinc, because it readily forms a solid amalgam, is a suitable medium in which to sequester mercury. See also U.S. Pat. No. 4,076,553, U.S. Pat. No. 3,975,298, and Japanese Patent Publication 2,296,926. However, because zinc has an electrode potential of 0.7628 volts, which is well above that of hydrogen, it is a very reactive metal. By comparison, copper has a potential of −0.345 volts, which is below that of hydrogen and is consequently much less reactive. In addition, zinc amalgam is attacked by water resulting in the formation of hydrogen and zinc hydroxide in contrast to copper amalgam which remains stable in water. Given sufficient water, all the zinc metal is consumed and the amalgamated mercury returns to its free and hazardous liquid form. Accordingly, it will be apparent that reactivity is unsuitable in a sorbent for storage or burial, rendering zinc as unsuitable for mercury sequestration where the resulting solid amalgam is to be buried or stored.

SUMMARY OF THE INVENTION

It is one object of this invention to provide a method for stabilization of liquid mercury, such as in an amalgam, which does not require the use of expensive sorbents such as gold or silver.

It is another object of this invention to provide a method for stabilization or liquid mercury which enables the formation of amalgams in which the mercury content is greater than 50% of the total mass of the amalgam.

It is yet another object of this invention to provide a method for stabilization of liquid mercury in an amalgam having a monolithic structure whereby the potential for leaching is reduced compared to powderous amalgams.

It is yet another object of this invention to provide a method for stabilization of liquid mercury which produces an amalgam which is substantially non-reactive.

These and other objects of this invention are addressed by a method for stabilization of liquid mercury comprising the steps of cleaning the surface of powdered copper particles with a chemically reactive fluid suitable for removing oxidation from the surface, mixing the "clean" powdered copper particles with liquid mercury, forming a powdered copper/liquid mercury mixture, and hardening the powdered copper/liquid mercury mixture to form an amalgam.

A freshly exposed copper surface will quickly react with atmospheric oxygen to form a mixture of cuprous and cupric oxides as a surface coating. Even if the surface coating is so thin as to be invisible, it prevents wetting by liquid mercury, which is a requirement for bringing the copper and mercury together at an atomic scale, an essential step in the formation of amalgams. Mechanical means such as agitation do remove the oxide coating, but only with difficulty. The method of this invention employs chemical means to remove the oxidation so that the mercury wets the copper surface rapidly and completely. In contrast to the process of the '054 patent discussed hereinabove, the method of this invention requires substantially less energy for agitation due to the advantages of chemical cleaning. Indeed, the method of this invention requires only as much energy as is provided by hand shaking or stirring a laboratory-size sample. The copper surface, when wetted by the liquid mercury, reacts at ambient temperature to form a hard alloy of mercury co-crystallized with copper. Chemical cleaning of the copper particles in accordance with the method of this invention results in a superior, more intimate contact between mercury and copper atoms, thereby enabling more complete reaction of the sorbent and a reduction in sorbent requirement compared to known amalgamation methods. Hard castings containing as much as 85% mercury by weight can be formed by the method of this invention.

DESCRIPTION OF PREFERRED EMBODIMENTS

The method for stabilization of liquid mercury in accordance with this invention comprises contacting powdered copper particles with a chemically reactive fluid suitable for removing surface oxidation from the surfaces of the particles, mixing the "clean" powdered copper particles with liquid mercury and hardening the resulting mixture to form an amalgam. In order to reduce the amount of copper in the amalgam, it is desirable that the ratio of liquid mercury to powdered copper, by weight of the amalgam, be as high as possible. Thus, although the method may be carried out wherein the ratio of liquid mercury to powdered copper is less than 1:1, it is preferred that the ratio of liquid mercury to powdered copper be greater than 1:1.

Any chemically reactive fluid which is capable of removing surface oxidation from the powdered copper particles may be utilized in the method of this invention. In accordance with one preferred embodiment of this invention, powdered copper particles in an atmosphere of hydrogen are heated to at least 500° C. and preferably to about 700° C. to reduce the cuprous and cupric oxides to metallic copper. The hydrogen, in addition to reducing the cuprous and cupric oxides to metallic copper, reacts with and volatilizes surface salts and corrosion products such as chloride, sulfate, acetate and carbonate. The reduction of copper in hot hydrogen changes the appearance of the copper to that of an untarnished, freshly-exposed surface. Liquid mercury then wets the copper immediately and completely, preferably in an atmosphere in which the powder is not exposed to oxygen or water vapor. Reduction with hot hydrogen in accordance with this embodiment of the invention has the advantage that no secondary mercury-bearing waste is formed.

In accordance with a second embodiment of the method of this invention, preparation of the powdered copper particle surfaces is carried out by immersing the copper particles in a cleaning solution of dilute hydrochloric acid and ammonium chloride. The proportions of ammonium chloride and hydrogen chloride in the solution need not be precise and a broad range ofproportions is acceptable. For example, a water solution containing about 10% ammonium chloride and 4% hydrogen chloride by weight produces excellent results. Preferably, this reactive cleaning fluid should not be concentrated.

After treatment of the powdered copper particles with the hydrochloric acid/ammonium chloride cleaning solution, the mercury is mixed with the powder and the resulting mixture agitated. In accordance with one embodiment of this invention, the liquid mercury, cleaning fluid and powdered copper particles are all combined simultaneously and agitated. If the copper surface appears brown or corroded, the chemical cleaning effect of this chemically reactive fluid can be accelerated by heating for a few minutes.

Regardless of whether the cleaning fluid is hot hydrogen gas, aqueous hydrogen chloride/ammonium chloride solution, or other chemically reactive fluid, surface deposits are removed and copper atoms are exposed. Mixing by shaking or stirring, for example, then causes mercury liquid to coat each copper particle. The high surface tension force, which is a characteristic of liquid mercury, then collects the copper particles into a continuous liquid mercury phase, expelling nonmetallic fluids from interparticle porosity and combining the metallic slurry into a common pool. This slurry mixture appears smooth, with rounded contours and has the color and metallic luster of mercury.

The powdered copper particles suitable for use in the method of this invention are not limited with respect to shape. If the powdered copper particles shapes are irregular, such as in the case of flakes or needles, and/or if the proportion of mercury is insufficient, the mixture appears irregular, porous and gray rather than shiny. In accordance with one embodiment of the method of this invention, the mixture is subjected to mechanical packing to expel cleaning fluid or rinse water, reduced porosity, and consolidate the slurry so that it is dense and appears shiny. Packing should produce a continuous phase of mercury, which contains the powdered copper particles, but little or no nonmetallic fluids. Packing may be done by any suitable method, for example, with a rod by hand, in a mortar and pestle, in a ball mill or centrifuge, by vibration, by shaking or stirring, or by repeatedly dropping the slurry in a container. The chemically reactive fluid separates above the metal slurry. The slurry is preferably separated from the chemically reactive fluids and then washed one or more times with water.

The slurry mixture produced in accordance with the method of this invention, when left undisturbed, hardens in a day or two at ordinary temperature. The time required for hardening and strengthening of the casting depends on both the proportion of mercury and the type of copper powder. An amalgam containing 70% by weight of mercury can be become as hard as pure copper. Surprisingly, elevated temperature interferes with hardening because heat can reversibly soften a previously hardened amalgam of this kind.

The powdered copper particles used as a sorbent in accordance with the method of this invention need not be pure. It may be mixed or alloyed with minor proportions of zinc, tin, silver, gold, indium, cadmium, bismuth, led, antimony, aluminum, silicon, beryllium, and other elements to form various alloys. By the term "minor proportions," we mean less than about 33% by weight of said alloy.

EXAMPLE 1

A chemically reactive fluid cleaning solution was prepared from 50 grams of ammonium chloride and 50 grams of concentrated reagent-grade hydrochloric acid diluted to 500 ml with purified water. A copper powder commercially available from Aldrich Chemical Company was separated into particle size fractions by sieving to produce a 50–100 mesh fraction, designated as "A50", a 100–325 mesh fraction, designated as "A100", and a fraction passing 325 mesh, designated as "A325". These powders were prepared by spray atomization of molten copper. Microscopically, even the smallest particles were porous agglomerates of still smaller particles which had come into contact and welded together before they solidified from the melt.

Another type of copper powder tested, designated as "C110" available from United States Bronze Powders, Inc. of Flemington, N.J., had also been prepared by spray atomization. However, it consisted principally of larger individual spheres, 50–60% passing 325 mesh.

Still another copper powder tested, designated as "D101", available from United States Bronze Powders, Inc., had been prepared electrolytically from an aqueous solution. This powdered copper appeared as irregular needles or shards, 60–80% passing 325 mesh.

Yet another copper powder, designated as "C102" available from United States Bronze Powders, Inc., consisted of microscopic flat flakes prepared by ball milling some of the atomized spherical powder with a stearic acid lubricant. The fraction of this powdered copper passing 325 mesh was 10–20%.

Various amalgams were prepared from the foregoing copper powders as follows. Powdered copper particles and liquid mercury were weighed into screwtop vials. Cleaning fluid was added in about three times the combined volume of metals, and the vials were promptly shaken by hand for 3–5 minutes. The fluid was then decanted off and the amalgam was rinsed by shaking four times with excess distilled water to remove the cleaning fluid.

Except as noted in Table 1 hereinbelow, this procedure produced a single shiny, generally round lump of metallic slurry having the color of mercury, with copper particles suspended in a continuous phase of liquid mercury. Exceptions occurred when the proportion of mercury was insufficient to fill spaces between copper particles from surface tension force alone. In these exceptional cases, the metal appeared irregular, porous and gray. The gray color indicates coating of copper particles with a film of mercury.

The samples were then packed into cylindrical molds for compressive strength testing. The slurry mixture was packed by hand using a rod in those cases where it was dull gray and visibly porous. Such packing eliminated porosity, expelled rinse water, and consolidated the slurry mixture into dense, shiny castings.

After undisturbed curing for two days at room temperature in the molds, solidified amalgam samples were ejected. About ten days after preparation, the samples were tested in a hydraulic press to measure their maximum compressive load. The results are shown in Table 1.

TABLE 1

Amalgam Castings made with Copper Particles

| Sample Number | Mercury Content Wt % | Material Identification | Particle Size, mesh | Material Shape | Compressive Strength[a], psi | Comments |
|---|---|---|---|---|---|---|
| 3 | 50.5 | A325 | −325 | Snow ball[b] | 14,957 | [c] |
| 4 | 60.4 | A325 | −325 | Snow ball[b] | 9,233 | |
| 5 | 65.1 | A325 | −325 | Snow ball[b] | 8,205 | |
| 6 | 69.6 | A325 | −325 | Snow ball[b] | 7,304 | |
| 7 | 60.4 | A50 | −50 + 100 | Snow ball[b] | 9,220 | |
| 8 | 60.4 | A100 | −100 + 325 | Snow ball[b] | 9,270 | |
| 9 | 69.6 | C102 | 10–20% < 325 | Flate flakes | 4,573 | [c] |
| 11 | 69.6 | C110 | 50–60% < 325 | Snow ball[b] | no casting | [d] |
| 12 | 69.6 | D101 | 60–80% < 325 | Irregular | 6,038 | [c] |
| 14a | 76.4 | D101 | 60–80% < 325 | needles or shards | 4,598 | 10 days |
| 14b | 76.4 | D101 | 60–80% < 325 | needles or shards | 6,038 | 24 days |
| 14c | 76.4 | D101 | 60–80% < 325 | needles or shards | 6,364 | 51 days |

[a]Compressive strength was determined 10 days after sample preparation, except for samples 14b and 14c. Strengths for samples 14b and 14c were determined 24 and 51 days after preparation, respectively.
[b]Snowball = spherical agglomerates of smaller spherical particles.
[c]Porous amalgam deficient in mercury had to be hand packed into the mold to expel cleaning fluid.
[d]Runny slurry did not harden well.

EXAMPLE 2

Copper powder D101 was sealed in a PYREX® tube in a cleaning fluid consisting of slowly flowing hydrogen gas. The powder was heated for ten minutes to slightly below the softening temperature of the PYREX, which is about 650° C. After cooling, mercury was introduced which immediately wetted the freshly clean copper surface. The mixture was shaken by hand to eliminate porosity and then was packed into a cylindrical mold. After two days, the solidified amalgam sample was ejected from the mold. The casting contained 80% mercury by weight.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

We claim:

1. A method for stabilization of liquid mercury comprising the steps of:

cleaning a surface of powdered copper particles with a chemically reactive fluid suitable for removing oxidation from said surface, resulting in clean powdered copper particles;

mixing said clean powdered copper particles with liquid mercury, forming a powdered copper/liquid mercury mixture; and hardening said powdered copper/liquid mercury mixture, forming an amalgam.

2. A method in accordance with claim 1, wherein said powdered copper/liquid mixture is packed prior to said hardening, resulting in expulsion of nonmetallic fluids, if any, from between said clean powdered copper particles and forming a continuous mercury phase comprising said clean powdered copper particles.

3. A method in accordance with claim 1, wherein a mass of said mercury is greater than a mass of said powdered copper particles.

4. A method in accordance with claim 1, wherein said chemically reactive fluid comprises hydrogen at a temperature of at least 500° C.

5. A method in accordance with claim 1, wherein said chemically reactive fluid comprises an aqueous solution comprising at least one of hydrochloric acid and ammonium chloride.

6. A method in accordance with claim 1, wherein said powdered copper particles are produced by spray atomization of molten copper.

7. A method in accordance with claim 1, wherein said powdered copper particles are produced by electrolysis of an aqueous solution.

8. A method in accordance with claim 1, wherein said powdered copper particles are alloyed with minor portions of other metallic elements.

9. A method in accordance with claim 5, wherein said ammonium chloride has a concentration in a range of about 0.10% to about 35% by weight of said aqueous solution.

10. A method in accordance with claim 5, wherein said hydrogen chloride has a concentration in a range of about 0.10% to about 35% by weight of said aqueous solution.

11. A method in accordance with claim 1, wherein said hardening is carried out at ambient temperature.

12. A method in accordance with claim 1, wherein said amalgam comprises greater than about 50% by weight Hg.

* * * * *